US008104486B2

(12) United States Patent
Imai et al.

(10) Patent No.: US 8,104,486 B2
(45) Date of Patent: Jan. 31, 2012

(54) HAIR-INCREASING DEVICE AND METHOD OF PRODUCING THE SAME

(75) Inventors: Sakiko Imai, Shinjuku-ku (JP); Katsuo Sugai, Shinjuku-ku (JP)

(73) Assignee: Unihair Co., Ltd., Tokyo (JP)

( * ) Notice: Subject to any disclaimer, the term of this patent is extended or adjusted under 35 U.S.C. 154(b) by 453 days.

(21) Appl. No.: 12/067,165

(22) PCT Filed: Sep. 25, 2006

(86) PCT No.: PCT/JP2006/318959

§ 371 (c)(1),
(2), (4) Date: Sep. 4, 2009

(87) PCT Pub. No.: WO2007/037200

PCT Pub. Date: Apr. 5, 2007

(65) Prior Publication Data

US 2010/0163069 A1 Jul. 1, 2010

(30) Foreign Application Priority Data

Sep. 27, 2005 (JP) ..... 2005-280876

(51) Int. Cl.

| | |
|---|---|
| ***A41G 5/00*** | (2006.01) |
| ***A41G 3/00*** | (2006.01) |
| ***D04G 5/00*** | (2006.01) |
| ***B65H 69/04*** | (2006.01) |

(52) U.S. Cl. ..... 132/201; 132/53; 289/1.2; 289/1.5

(58) Field of Classification Search ..... 132/53–56, 132/200, 201; 623/15.11; 446/394; 112/416, 112/22, 156, 409, 169, 475.17; 289/1.2, 289/1.5, 16.5, 18.1; 606/139, 144, 148
See application file for complete search history.

(56) References Cited

U.S. PATENT DOCUMENTS 892,889 A * 7/1908 Rehfuss ..... 112/409

(Continued)

FOREIGN PATENT DOCUMENTS

JP 48-51754 A 7/1973

(Continued)

OTHER PUBLICATIONS

International Search Report (ISR) for PCT/JP2006/318959 for Examiner consideration, citing foreign references Nos. 1-4 listed above.

(Continued)

*Primary Examiner* — Todd Manahan
*Assistant Examiner* — Vanitha Elgart
(74) *Attorney, Agent, or Firm* — Chen Yoshimura LLP

(57) ABSTRACT

This invention relates to a hair increasing device that improves the freedom of hair styles and, is constituted in such a manner that each hair is knotted to a rib constituting a hair-secured frame with one end portion being twice wound, and the other end portion being once wound and pulled out thereafter. The one end portion of the tied hair is supported so as to stand upright with regard to a rib, and the other end portion is knotted so as to extend longitudinally on and along a rib, and thereby hair flow is formed in the longitudinal direction on a plurality of ribs so that the plurality of ribs is covered and hidden, and becomes hardly visible. Hence the rib or wig base linear member is hardly visible, the knot does not loosen, and the hair increasing device provides a rich voluminous appearance and allows versatility of hair styles.

13 Claims, 15 Drawing Sheets

U.S. PATENT DOCUMENTS

| | | | | | |
|---|---|---|---|---|---|
| 1,740,764 | A | * | 12/1929 | Bong | 132/201 |
| 2,122,526 | A | * | 7/1938 | Kattermann | 112/413 |
| 2,814,301 | A | * | 11/1957 | Schmitz | 132/201 |
| 2,906,224 | A | * | 9/1959 | Henry | 112/475.17 |
| 3,645,276 | A | * | 2/1972 | Cho | 132/201 |
| 3,709,536 | A | * | 1/1973 | Huber | 289/1.5 |
| 3,862,638 | A | * | 1/1975 | Fannin | 132/53 |
| 3,970,092 | A | * | 7/1976 | Nelson | 132/201 |
| 4,182,527 | A | * | 1/1980 | Meehan | 289/1.5 |
| 4,296,765 | A | * | 10/1981 | Bachtell | 132/53 |
| 4,372,330 | A | * | 2/1983 | Nelson | 132/53 |
| 4,711,476 | A | * | 12/1987 | Hanson | 289/1.2 |
| 4,793,368 | A | * | 12/1988 | Yamada | 132/53 |
| 4,799,502 | A | * | 1/1989 | Kobayashi et al. | 132/53 |
| 5,044,382 | A | * | 9/1991 | Ando et al. | 132/54 |
| 5,368,052 | A | * | 11/1994 | Finamore | 132/54 |
| 5,406,971 | A | * | 4/1995 | Taylor | 132/201 |
| 5,533,529 | A | * | 7/1996 | Ohno | 132/200 |
| 5,573,286 | A | * | 11/1996 | Rogozinski | 289/1.2 |
| 5,643,293 | A | * | 7/1997 | Kogasaka et al. | 606/148 |
| 5,728,109 | A | * | 3/1998 | Schulze et al. | 606/139 |
| 5,775,341 | A | * | 7/1998 | Abe et al. | 132/201 |
| 5,799,599 | A | * | 9/1998 | Tsukioka et al. | 112/65 |
| 6,143,006 | A | * | 11/2000 | Chan | 606/148 |
| 6,691,714 | B1 | * | 2/2004 | Yaguchi et al. | 132/201 |
| 6,910,486 | B2 | * | 6/2005 | Makino et al. | 132/201 |
| 7,331,351 | B1 | * | 2/2008 | Asai | 132/53 |
| 7,533,675 | B2 | * | 5/2009 | Takemura | 132/201 |
| 7,836,899 | B2 | * | 11/2010 | Sugai et al. | 132/201 |
| 2003/0000540 | A1 | * | 1/2003 | Makino et al. | 132/201 |
| 2003/0226571 | A1 | * | 12/2003 | Rahman | 132/201 |
| 2006/0090772 | A1 | * | 5/2006 | Hong | 132/201 |
| 2008/0041405 | A1 | * | 2/2008 | Kitsu et al. | 132/201 |
| 2008/0092913 | A1 | * | 4/2008 | Sugai et al. | 132/53 |
| 2009/0071492 | A1 | * | 3/2009 | Oh | 132/201 |
| 2009/0165810 | A1 | * | 7/2009 | Sotokawa et al. | 132/54 |
| 2010/0307524 | A1 | * | 12/2010 | Kuroyanagi et al. | 132/201 |

FOREIGN PATENT DOCUMENTS

| | | | |
|---|---|---|---|
| JP | 52-106957 | A | 9/1977 |
| JP | 53-143772 | A | 12/1978 |
| JP | 03-206108 | A | 9/1991 |
| JP | 2002-115115 | A | 4/2002 |

OTHER PUBLICATIONS

PCT/ISA/237 in PCT/JP2006/318959 and its translation of Section V.

Translation of PCT/ISA1237, IB326, IB338, and 18373 of PCT/JP2006/318959.

* cited by examiner (A)

Prior Art (B)

Prior Art
(B)

Prior Art
(C)

Prior Art
(B)

Prior Art
(C)

Prior Art
(D)

Prior Art
(B)

Prior Art
(C)

Prior Art
(B)

Prior Art
(C)

Prior Art
(D)

HAIR-INCREASING DEVICE AND METHOD OF PRODUCING THE SAME

TECHNICAL FIELD

The present invention relates to a hair-increasing device which can be utilized for a wig covering the thinning areas of a head, for example, a hair-increasing device which can attach hair to a wig base in good appearance mainly composed of a net member made of filaments arranged in a lattice-like pattern, or to a hair-secured frame formed by assembling longitudinal ribs having rigidity and elasticity, and a method of producing the same.

BACKGROUND ART

A wig comprises in general a sheet-like or film-like wig base formed with artificial skin made of thin synthetic resin and hair planted on said wig base. In cases where hair is thus planted on a wig base formed film-like with artificial skin or others, hair flow or hair amount can be freely designed depending upon the user's preferred hair style, using known hair planting arts such as single, half-knot, and split-knot plantings.

For example, if desired to finish in back style, hair is planted from the forehead to the top portion so to extend backward, and to make the hair appear to flow backwards at an angle on side head portions.

Also, in case to form a hair-dividing portion or a hair whorl in a wig base of artificial skin, hair flow or hair density can be freely designed so to extend in the pre-determined direction.

Thus, for a wig base formed sheet-like, film-like, or plane-like with densely woven textile, hair style can be freely expressed depending upon the user's preference by properly mixing known hair-planting arts.

Here, when the hair is in an early stage of thinning, or it is desired to increase hair amount only at a portion of a head, it is annoying to use a wig base formed film-like with artificial skin which has high airtightness, and hence a hair-increasing device mainly comprising light nets excellent in air permeability is used, instead of an artificial skin base as a more convenient hair piece.

As such a hair-increasing device, a net base composed with filaments arranged lattice-like in matrix, or a hair-secured frame formed in the shape of a rib cage by assembling longitudinal linear ribs having rigidity and elasticity is often used.

For example, as is schematically shown in a diagonal view of FIG. 13, the hair-increasing device 30 comprising a rib cage-shaped hair-secured frame 32 and hair 33 knotted to said hair-secured frame 32 is currently in wide use, as, in addition to its lightness and excellent air permeability, the appropriate desired hair-increasing treatment is possible, and arbitrary variation of hair style can be expressed, fully utilizing the user's own hair.

The rib cage-shaped hair-increasing device 30 comprises a hair-secured frame 32 having a connecting rib 32*a* at the center and a plurality of ribs 32*b* extending at both sides from said connecting rib 32*a*, and is formed by curving along the user's head shape (See Patent reference 1).

Hair 33 is knotted densely to respective ribs 32*a* and 32*b* of said hair-secured frame 32, though only its portion is shown in FIG. 13, and most of hair 33 is omitted.

Hair 33 is knotted to respective ribs 32*a* and 32*b* of said hair-secured frame 32 by the above-mentioned known knotting.

FIG. 14 is an enlarged diagonal view schematically illustrating hair flow of the hair 33 knotted by, for example, half-knot planting.

A strand of hair or a few strands of hair 33 are bound and bent at a center, and said bent portion is secured with knots 33*c* formed in 32*a* and the ribs 32*b*.

Here, the term "planting" or "hair planting" is used to convey the concept which would widely include the cases to knot hair to linear members or to attach hair on a film-like wig base by sewing or bonding.

However, in cases where hair is attached on said net base or to a hair-secured frame, since filaments or ribs (hereinafter, these are termed as linear members as a whole) are all made of thin and long linear members, hair is wound and knotted to said linear members by using known hair planting arts such as single, half-knot, and split-knot plantings.

Therefore, unlike hair planting to artificial skin, the flow of the hair attached to filaments or ribs has to be restricted in a certain direction.

That is, in either case of a net member or a hair-secured frame, since it is formed by assembling linear members in matrix or diagonal direction, in case, for example, to knot hair to the linear members arranged in the forward and backward direction of a head, hair flow is necessarily in the direction in which one end portion and the other of the knotted hair are both orthogonally crossing to the linear members, that is, divided left and right, and hence the backward hair flow is difficult in case, for example, back style is desired.

Explanation is made here, referring to FIGS. 15-17, of the case to apply the known single, half-knot and split-knot planting to said linear member 32*b* arranged in back and forth direction of the hair-secured frame as shown in FIG. 14 to knot hair 33.

In FIG. 15, the upper end of the linear member 32*b* is assumed to be arranged in the forehead direction, and the lower end in the backhead direction.

The single planting is the method to form a loop 34 by twisting the bent hair 33 (See FIG. 15(A)), winding said loop 34 from the lower to the upper side of the linear member 32*b* with a hair-tying needle, and to knot after pulling out both one end portion 33*a* and the other end portion 33*b* of hair from the loop 34 (See FIGS. 15 (B) and (C)).

Therefore, both one end portion 33*a* and the other end portion 33*b* of the hair knotted by single planting are horizontally supported in the right angle direction to the linear member 32*b* arranged in the back and forth direction of the head, forming the right side hair flow in the figure.

The half-knot planting is, as shown in FIG. 16, the method to form a loop 34 by twisting the bent hair 33 (See FIG. 16(A)), winding said loop 34 like the above-mentioned case from the lower to the upper side of the linear member 32*b* with a hair-tying needle (See FIG. 16(B)), and next to knot only the other end portion 33*b* of hair to the linear member after pulling out from the loop 34 (See FIG. 16(C)). By this method, the leftward and rightward direction hair flow is formed in which one end portion 33*a* of hair orthogonally crosses to the left side of the linear member 32*b*, and the other end portion 33*b* to the right side in the figure, and both one end portion and the other end portion of hair do not stand up in the planted state, but are knotted as the lying state.

The split-knot planting shown in FIG. 17 is the method to form a loop 34, as shown in (A), by twisting clock-wise the bent hair 33 (See FIG. 17(B)), to form a second loop 35 like the above-mentioned case with the other end portion 33*b* by passing the other end portion 33*b* of hair through the loop 34 (See FIG. 17(C)), and next to knot one end portion 33*a* to the linear member after pulling out from the second loop 35 (See FIG. 16(D)). By this method, one end portion 33*a* of hair stands diagonally upward with regard to the linear member 32*b* in the figure, but the other end portion 33*b* lies to the left of the linear member to form a crossing hair flow. Here, since a loop 34 is formed by clock-wise twisting in the illustrated example, the hair flow like one end portion 33*a* and the other end portion 33*b* of hair of FIG. 17(D) is formed, but if a loop 34 is formed by anticlock-wise twisting and knotted sequentially, the other end portion 33*b* of hair stands diagonally upward with regard to the linear member 32*b*, but one end portion 33*a* lies likewise in the orthogonal direction to the linear member to form crossing hair flow.

[Patent Reference 1] JP Laid-open publication 2002-115115 A

SUMMARY OF THE INVENTION

Problems to be Solved

As explained above, by any of the known hair planting methods, hair 33 has to be knotted orthogonally in the left and right direction with regard to the linear member 32*b*.

Therefore, first of all, since hair extends left and right with regard to the linear member 32*b* arranged in the back and forth direction of the head, it is difficult to design hair flow in the directions of forehead or backhead, and it tends to cause hair divided left and right, thereby the degree of freedom of hair style is restricted.

That is, since the base end side closer to the hair knot is knotted in the sideward direction, that is, in the directions of left and right side head portions, even if natural backward hair flow is to be made from the forehead to the backhead portion, hair tends to have a sideward flow after a while due to its elasticity even if combed to make the tip side of hair flowing backward, resulting in separation from the user's own hair.

Thus, conventional knotting methods can only restrict the freedom or the versatility of hair style.

Secondly, since the linear member 32*b* is arranged orthogonally to the hair flow direction of hair 33, it is difficult to cover the linear member 32*b* completely with hair, and it might be possible for the linear member to be visible as a longitudinal line from the user's front or the upper side, and hence there is a problem that a hair-increasing device tends to be visible when worn.

Thirdly, both known hair knotting methods, especially the single or half-knot planting, cause the knotted hair to lie sideward as explained above, and hair does not stand upright even if knotted densely, resulting in a feeling of not having thick hair (rich voluminous appearance). Also, split-knot planting causes one end portion of hair to stand upright, but the other end portion to lie likewise in the orthogonal direction to the linear member.

Fourthly, both known methods tend to cause the knots to loosen. Therefore, a hair fixing process to firmly fix the hair 33 to the linear members 32*a* and 32*b* is indispensable after knotting.

In order to firmly fix hair, adhesive solution diluted with organic solvent is applied and cured from the back side of linear members 32*a* and 32*b* after the hair 33 is knotted, so-called resin coating has to be applied (not shown in the figure), and the knotted portion of the hair 33 has to be sandwiched between the ribs 32*a* and 32*b* and resin coating to be fixed and held.

As explained above, in case where hair is knotted and attached to a linear member of a net base or a rib-type hair-secured frame, the conventional planting method knots hair 33 to a linear member so to extend perpendicular, and hence hair does not stand upright and has a sensation of not having thick hair due to lying down of hair.

Also, since hair is knotted to the linear member sideward, the linear member is not completely hidden. Therefore, the sire material tends to be visible through hair gaps, and there is a problem that the use of a wig may be apparent.

Furthermore, even if hair 33 knotted to the linear member is combed by brushing, it is difficult to align the hair flow in the longitudinal direction of the linear members 32*a* and 32*b*, that is, to give the hair flow toward a back head or a forehead portions, and hence there is a problem of poor freedom of hair style.

One of the objects of the present invention is, in reference to the above-mentioned problems, to provide a hair-increasing device capable of making a linear member hardly visible because it is hidden with hair, the hair knot hardly loosened, causing good upright standing of the knotted hair, and giving free hair flow from the forehead toward the back of the head.

Another object of the present invention is to provide a new method of hair securing to the hair-increasing device, and a method of producing a hair-increasing device with said hair planting method applied thereto.

Here, a hair-increasing device of the present invention includes a wig base made mainly of net members produced by assembling filaments in mesh shape, and a hair-secured frame with hair knotted thereto produced, for example, rib cage-shaped with synthetic fiber having rigidity and elasticity similar to that of strings of a tennis racket, but, not limited only to them, but also includes known wigs made of a film-like wig base of artificial skin or others, and also a method of hair securing in accordance with the present invention is applicable to any wig.

Means to Solve Problems

In order to achieve one of said objects, a hair-increasing device in accordance with an embodiment of the present invention is characterized to have a linear member and hair tied to said linear member, bent hair being knotted to said linear member, its one end portion extending from the knot standing upright with regard to said linear member, and the other end portion extending from the knot on and along said linear member.

That is, the hair-increasing device of the present invention is such that the bent portion of bent hair is knotted by twice winding said one end portion of hair around the linear member, and by once winding and pulling out thereafter the said other end portion, thereby said one end portion of hair stands upright from the linear member, and the said other end portion of hair is secured on the linear member to make hair flow extending along the longitudinal direction of said linear member.

More concretely, the hair-increasing device of the present invention has a first loop formed by twisting the bent portion of bent hair, a second loop formed on said one end portion by winding said first loop to the linear member, and passing said one end portion of the bent hair into the first loop, a third loop formed on said one end portion by passing said one end portion into the second loop, and a knot formed with said one end portion and the said other end portion of hair by tightly binding the first, the second, and the third loops, characterized in that said one end portion of hair stands and extends upward from the knot with regard to the linear member, and the said other end portion of hair extends from the knot on and along the linear member after pulled out of the third loop.

That is, said one end portion of hair is pulled out of the third loop, and is supported with said third loop to stand upright and extend upward with regard to the linear member, whereas the said other end portion of hair is clipped between the linear member and the lower side of the second loop pushed down by the third loop, and lies on said linear member to extend along.

According to each of said aspects, as to the bent portion of bent hair, since said one end portion is wound twice, while the said other end portion is once wound and pulled out thereafter, and hence one half and the other half of hair are knotted to the linear member, the knot will not loosen, and is firmly knotted.

Also, since one half of the hair knotted to the linear member stands upright and extends vertically from the linear member to give hair flow in a direction of vertically standing upright, a sensation of having thick hair (rich voluminous appearance) increases, and hair-increasing appearance is realized by relatively small hair planting amount.

Further, since the said other end portion of hair lies along the linear member and extends in its longitudinal direction, the surface side (upper side) of the linear member is covered and hidden with the said other end portion of hair knotted in plurality in parallel. Therefore, since the linear member is hidden with hair, and becomes invisible, the use of a hair-increasing device has no possibility of exposure.

In order to achieve said another object, the present invention provides a method of knotting hair to the linear member constituting a hair-increasing device, characterized in that it includes a first step to bring a hair-tying needle at the lower side of the linear member, hook and scoop with the hair-tying needle the bent portion of the bent hair, and thereby to form a first loop by twisting, a second step to form a second loop by winding said first loop to the linear member and scooping said one end portion of hair with the hair-tying needle inserted through the first loop at said one end portion of said hair scooped through the first loop, a third step to form a third loop by scooping again said one end portion of hair with the hair-tying needle inserted through the second loop at said one end portion of hair scooped through the second loop, next a fourth step to scoop the said other end portion of hair with the hair-tying needle inserted through the third loop and to completely pull out the said other end portion of said scooped hair from the third loop, and finally a fifth step to have one end portion of hair stand upright on the linear member by tightly binding the first, the second and the third loops, and have the said other end portion lie and extend on and along said linear member.

In order to further achieve said another object, the present invention provides a method of producing a hair-increasing device having a linear member and hair tied to the linear member, characterized in that a process of knotting hair to the linear member is constituted with a first step to bring a hair-tying needle at the lower side of the linear member, hook and scoop with the hair-tying needle the bent portion of the bent hair, and thereby to form a first loop by twisting, a second step to form a second loop by winding said first loop to the linear member and scooping said one end portion of hair with the hair-tying needle inserted through the first loop at said one end portion of said hair scooped through the first loop, a third step to form a third loop by scooping again said one end portion of hair with the hair-tying needle inserted through the second loop at said one end portion of hair scooped through the second loop, next a fourth step to scoop the said other end portion of hair with the hair-tying needle inserted through the third loop and to completely pull out the said other end portion of said scooped hair from the third loop, and finally a fifth step to have said one end portion of hair stand upright on the linear member by tightly binding the first, the second and the third loops, and have the said other end portion lie and extend on and along said linear member, and, by repeating said first to fifth steps sequentially, hair is tied to said linear member while said linear member is covered with the said other end portion of hair.

Said first loop can be formed by twisting half a turn of the bent portion of the bent hair, and crossing the said other end portion over said one end portion of hair.

At the second step, the second loop may be formed by passing said one end portion of the scooped hair into the first loop, and said second loop may be twisted half a turn.

At the third step, the third loop may be formed by passing said one end portion of hair into the second loop, and said second loop may be twisted half a turn.

At the fifth step, when said one end portion of hair is pulled, said first, second and third loops are tightened, and at the same time the third loop passes the second loop, protrudes through said second loop, and opens in a vertical direction with regard to the linear member at the top position, and said one end portion of hair is supported by the third loop to stand upright with regard to said linear member by passing through the opening of the third loop from the lower side to protrude upward, and further the said other end portion of hair is clipped between the second loop and the linear member, as the third loop presses the second loop downward, to extend on and along said linear member longitudinally.

The linear member used for the present invention may be filaments to constitute the net member of a wig base, or may be composed of a rib cage-shaped rib formed by assembling a plurality of rigid synthetic fiber filaments having elasticity. A frame of the predetermined shape made by assembling a plurality of ribs may be used as a hair-secured frame for hair-increasing.

In said aspect, hair may be knotted to each rib constituting a hair-secured frame after forming a frame of the predetermined shape made by assembling a plurality of ribs, or, after knotting hair to a rib in advance, a hair-secured frame may be constituted by assembling a plurality of knotted ribs in matrix shape.

Here, the method of hair tying of the present invention is of course applicable to a film-like wig base made of artificial skin or textile, and these cases are also included within the range of the present invention.

Effect of the Invention

According to the present invention, since hair knotted to the linear member is such that said one end portion of hair stands upright and extends vertically from the linear member, it provides a good upright angle and a sensation of having a good standing and rich voluminous appearance of hair, and since the said other end portion extends in the longitudinal direction of the linear member, hair flow can be formed along the longitudinal direction of the linear member. Therefore, the hair-increasing device can be easily produced in which a linear member is hardly visible because it is covered and hidden by the said other end portion of hair, knots do not easily loosen, excels in appearance and rich voluminous appearance, and various hair styles can be freely designed.

Also according to the method of hair knotting of the present invention, it is possible to knot hair, not only to said sire material but also to a film-like wig base, so as to make hair styles freely, and to knot for not easily loosened knots and good upright standing.

EXPLANATION OF MARKS AND SYMBOLS

10: Hair-increasing Device
11: Hair-secured Frame
11*a*: Connecting Rib
11*b*: Rib (Linear member)
12: Hair
12*a*: One end of Hair
12*b*: The Other end of Hair
20: Hair Planting Needle
21: First Loop
22: Second Loop
23: Third Loop

BEST MODES FOR CARRYING OUT THE INVENTION

The present invention will be more fully understood from the detailed description given hereinbelow and the accompanying drawings which are given by way of illustration only, and thus are not limitative of the present invention.

A hair-increasing device of the present invention comprises linear members arranged in lattice shape and the hair tied to these linear members, in which the hair paired by bending at about the middle portion is knotted to the linear member by binding one strand or a few strands of hair, one end portion of this pair of hair stands and extends upward with regard to the linear member from the knot, and the other end portion lies and extends from the knot on and along said linear member. Therefore, rich voluminous appearance is excellent, as one end portion stands upright with regard to the linear member by knotting a number of hairs densely to the linear member according to the present invention. Also, since the other end portion of hair extends along the longitudinal direction of the linear member, the linear member can be covered and hidden with the other end portion of hair.

Figure 1:
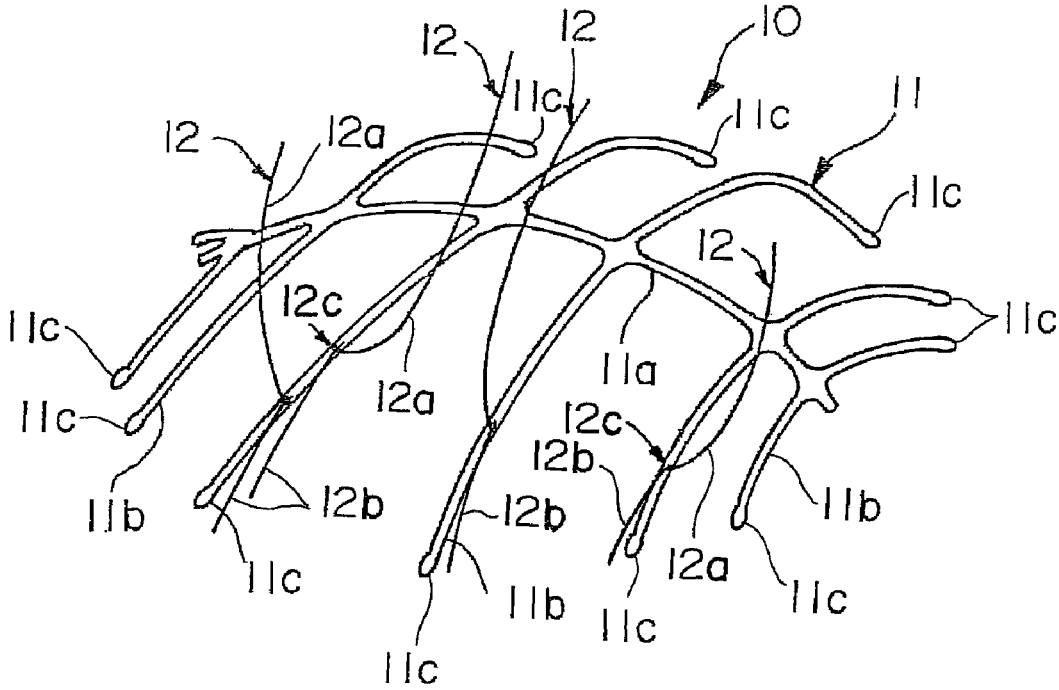
FIG. 1 is a diagonal view schematically illustrating an embodiment of a hair-increasing device in accordance with the present invention.

FIG. 1 illustrates an embodiment of a hair-increasing device in accordance with the present invention. In the embodiment below, a hair-increasing device is explained as an example which uses ribs 11*a* and 11*b* formed with the rigid and elastic synthetic fiber of relatively large diameter as a linear member, and comprises a rib cage-shaped hair-secured frame 11 made by combination of a plurality of said ribs and hair 12 knotted to said hair-secured frame 11.

Figure 13:
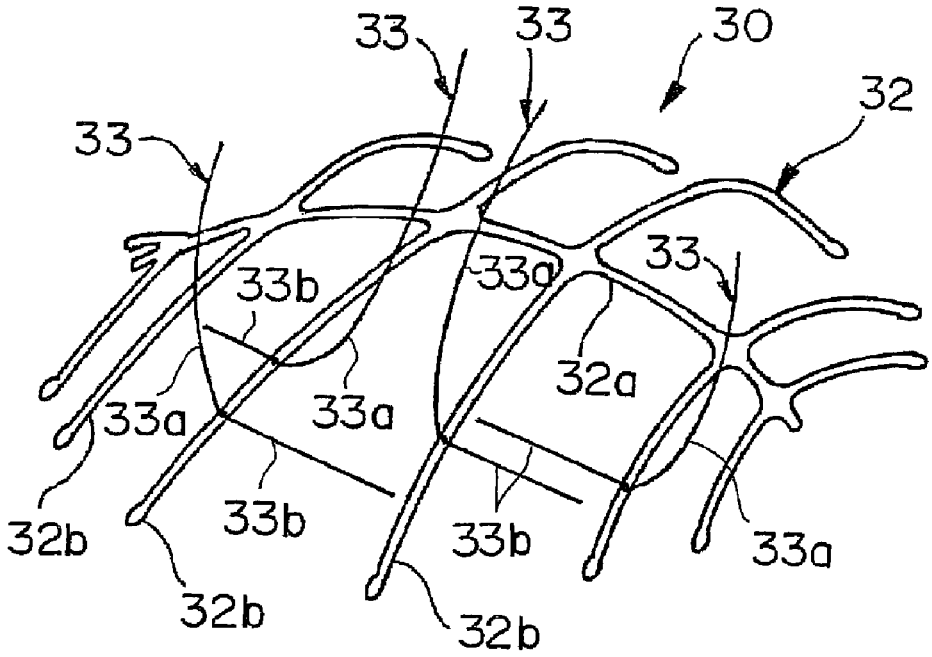
FIG. 13 Prior Art
FIG. 13 is a diagonal view schematically illustrating the constitution of an embodiment of a conventional hair-increasing device.
Figure 14:
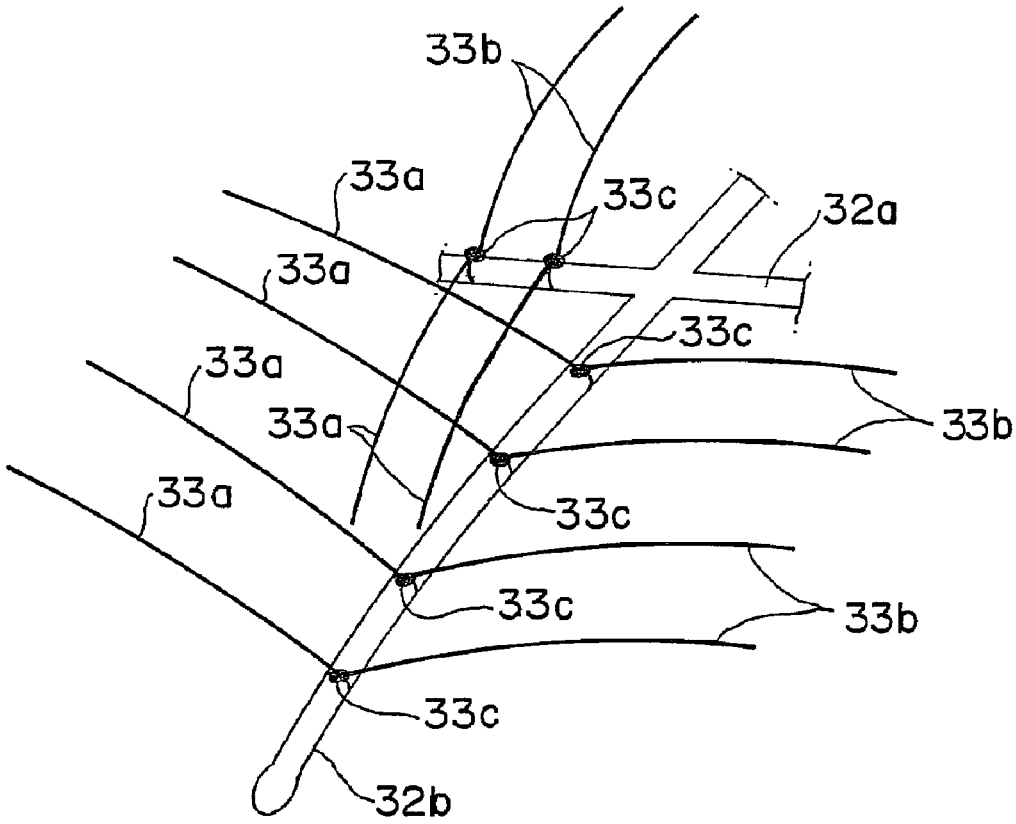
FIG. 14 Prior Art
FIG. 14 is an enlarged diagonal view schematically illustrating hair flow of the hair tied to the linear member of FIG. 13.
Figure 15:
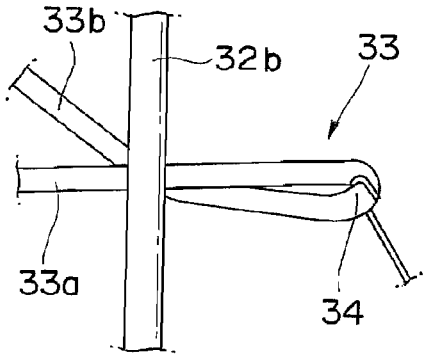
FIG. 15 Prior Art
FIG. 15 is an illustrative view sequentially showing the planting method by conventional single planting.
Figure 15:
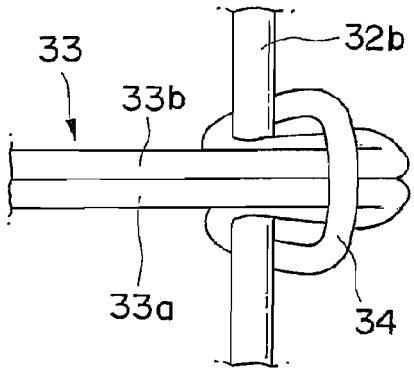
FIG. 15 Prior Art
Figure 15:
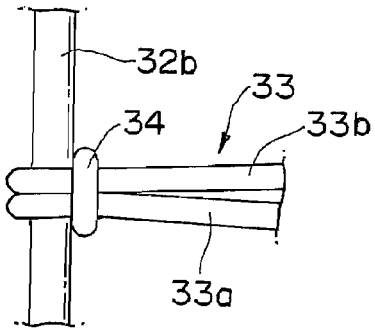
FIG. 15 Prior Art
Figure 15:
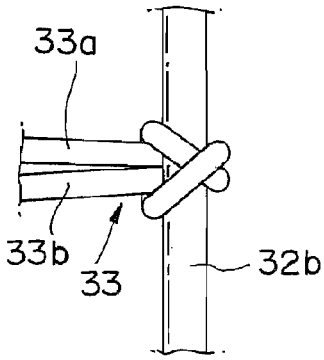
FIG. 15 Prior Art
Figure 16:
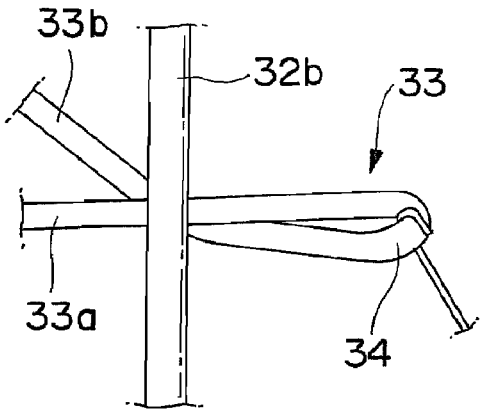
FIG. 16 Prior Art
FIG. 16 is an illustrative view sequentially showing the planting method by conventional half-knot planting.
Figure 16:
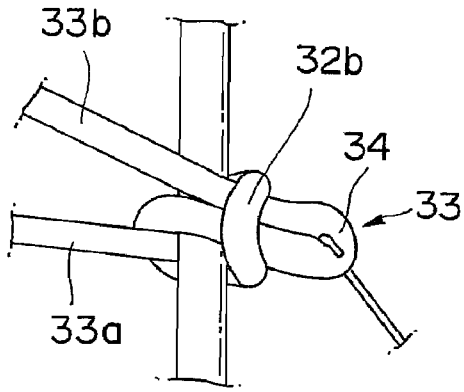
FIG. 16 Prior Art
Figure 16:
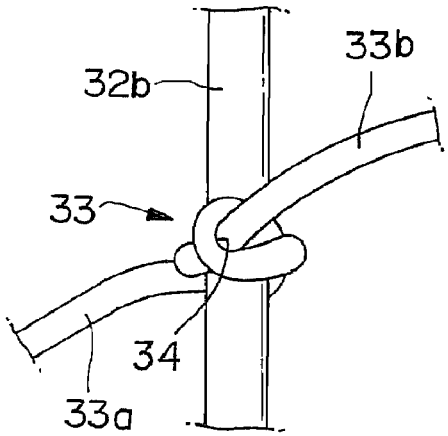
FIG. 16 Prior Art
Figure 17:
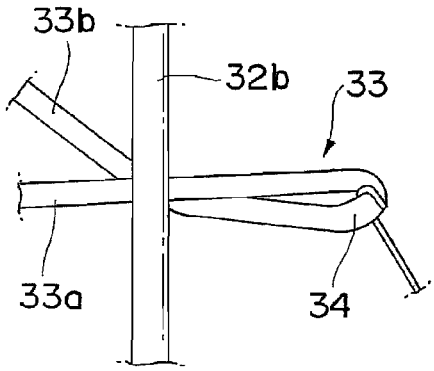
FIG. 17 Prior Art
FIG. 17 is an illustrative view sequentially showing the planting method by conventional split-knot planting.
Figure 17:
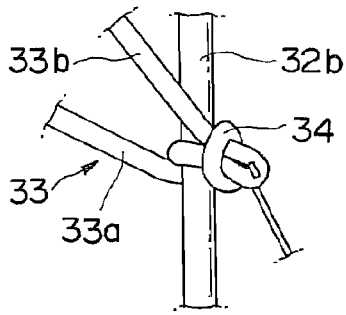
FIG. 17 Prior Art
Figure 17:
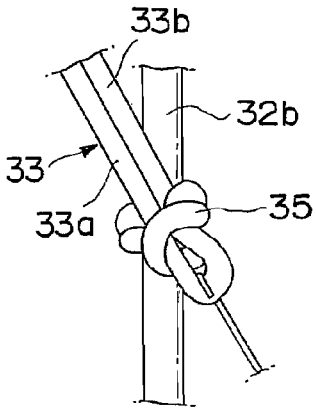
FIG. 17 Prior Art
Figure 17:
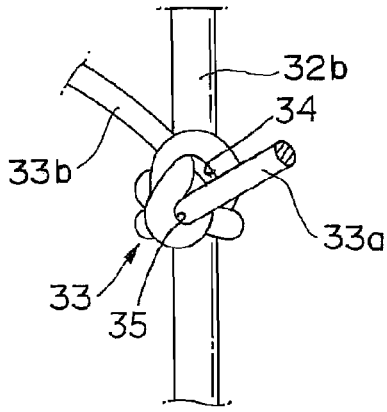
FIG. 17 Prior Art

Said hair-secured frame 11 is constituted similarly to a hair-secured frame 2 of the conventional rib type hair-increasing device 1 shown in FIG. 13, and is provided with a connecting rib 11*a* at the center, and a plurality of ribs 11*b* connected to said connecting rib 11*a* and extending to both sides.

Both connecting rib 11*a* and a plurality of other ribs 11*b* are made of same materials of about same diameter, and, for example, the connecting rib 11*a* illustrates a rib cage structure of a horizontal direction (that is, the direction of the user's left and right side head portion), and a plurality of the other ribs 11*b* illustrates a rib cage structure of a longitudinal direction (the direction from the user's forehead to back head portions).

Said hair-secured frame 11 is formed so that its whole including ribs 11*a* and 11*b* curves along the user's head shape. At both ends of ribs 11*a* and 11*b* are preferably formed swollen portions 11*c*.

By forming said swollen portions 11*c* in approximately a swollen spherical shape, the hair attached to each rib can be prevented from falling off, and contact with scalp is made soft so that injuring scalp can be prevented.

As the material for the ribs 11*a* and 11*b*, such synthetic resin material as nylon (polyamide synthetic fiber) and polyester that would neither injure the user's scalp nor be thermally distorted by a drier or others is preferred, and, in addition, the materials having elasticity and rigidity such as metal, hard paper, hard rubber, wood, bamboo, glass fiber and carbon fiber can be used.

Said hair 12 is made of human hair or artificial hair, and is knotted to ribs 11*a* and 11*b* at the loop side formed at the bent portion by binding and bending at about the middle portion one strand or a plurality of strands of hair 12.

Figure 2:
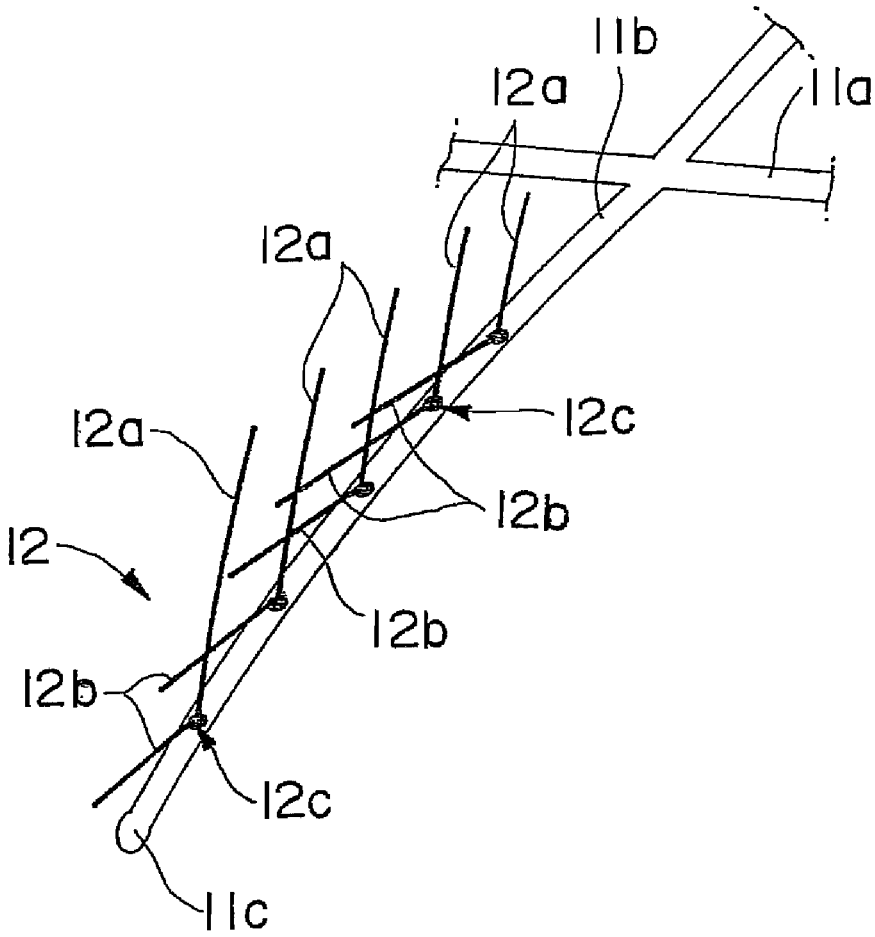
FIG. 2 is an enlarged diagonal view schematically illustrating the flow of the hair tied to the rib of FIG. 1.

FIG. 2 is an enlarged diagonal view schematically illustrating the flow of the hair 12 tied to the rib 11*b* of FIG. 1.

As is illustrated, each hair 12 is knotted by binding one strand or a plurality of strands of hair, and bending at about a middle portion to make a pair of one end portion 12*a* and the other end portion 12*b*, so that said one end portion 12*a* stands upright in approximately a perpendicular direction from the rib 11*b*.

As the base portion of one end portion 12*a* of hair is knotted in the perpendicular direction, a sensation of having thick hair (rich voluminous appearance) can be realized with little hair tying amount, compared with the hair lying along a scalp.

The other end portion 12*b* of a hair portion is knotted along the longitudinal direction of the rib 11*b* and lies and extends on the upper surface of the rib 11*b*.

Therefore, the rib 11*b* is covered and hidden with the other end portion 12*b* of hair 12.

Thereby, since hair flow is formed along the longitudinal direction of the rib 11*b*, natural hair flow can be formed, and the degree of freedom of hair styles is improved, and thereby exposure of a hair-increasing device can be prevented. Here, hair knotting to a connecting rib 11*a* can be conducted similarly, but it may be by a known knotting method for a connecting rib 11*a* to be worn in the traversal direction, that is, in the direction of a user's left and right side head direction.

As for each hair 12 knotted to a hair-secured frame 11 of the hair-increasing device 10, as described below, since one end portion of hair 12*a* is wound twice, and the other end portion is once wound and pulled out thereafter for knotting, the knot 12*c* shown in FIG. 12 would not loosen, and further since the other end portion is wound once, the knot 12*c* would not become too large.

Since knotted on the upper side of the rib (the opposite side of scalp), the knot 12*c* would not contact scalp to cause bad feeling on skin upon wearing of the hair-increasing device 10. Since also one end portion of hair 12*a* is supported by said knot 12*c* so as to stand upright vertically from both sides, rich voluminous appearance can be increased with little hair planting amount, whereas the other end portion of hair 12*b* is supported by said knot 12*c* horizontally so as to extend in the longitudinal direction of the rib 11*b*, the rib is hidden by the other end portion of hair 12*b*, as well as hair flow can be formed in the forward and backward direction from a user's forehead portion to back head portion.

The hair-increasing device 10 of the present invention uses a wig base made of a net member of wide meshes, or a rib cage-shaped hair-secured frame like the above-mentioned example, and is suitable to a so-called living hair-utilizing type wig used by mixing with the user's own hair.

For wearing the hair-increasing device 10 of the present invention on a head, it is possible by attaching a specific stopper on the back side of the hair-increasing device 10, and clipping living hair on a head with said stopper, or by knitting living hair into the hair of a wig, or knotting living hair to a string member provided on the periphery of a base.

Explanation is next made of an example of the case to attach hair to a rib using said hair-secured frame by a producing method of the hair-increasing device 10 of the present invention.

First, a hair-secured frame of the predetermined shape is produced. More concretely, twisted fiber of nylon of 0.1-3.0 mm diameter or the like, for example, is made ready as ribs 11*a* and 11*b* constituting a hair-secured frame 11, and it is formed by assembling appropriate number of strands, and mutually jointing these cross sections by such various methods as adhesion, knotting, sewing and melting so that the predetermined shape is prepared suitable to the wearer's head shape. In this case, as shown in FIG. 1, longitudinal ribs 11*b* are bonded one by one at proper intervals to connecting ribs 11*a* as crossing ribs.

Next, the hair-secured frame 11 prepared by connection is placed on a pattern prepared in advance of the wearer's head shape, for example, a plaster type, and a pattern is prepared for the wearer's head shape by heating for the pre-determined time at the pre-determined temperature.

Here, if the surface of each rib 11*a* and 11*b* is made coarse with sand paper or else, the gloss of the rib surface is suppressed, and the fall off or misalignment of the hair 12 attached by the later process is better prevented. A swollen portion 11*c* is also formed at both tips of each rib 11*a* and 11*b* to prevent fall off of the knotted hair 12 and to protect a scalp. On the thus formed hair-secured frame 11, hairs are attached one by one according to the hair planting method of the present invention.

Hereinafter, explanation is made of embodiments of the knotting method of hair 12 in accordance with the present invention.

Figure 10:
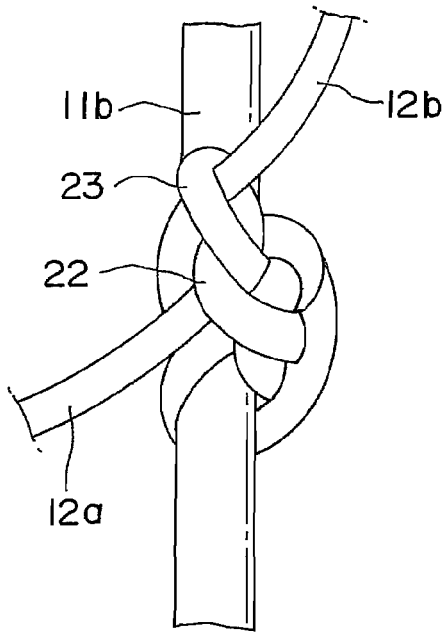
FIG. 10 is a partially enlarged view of the state to pull out the other end portion of hair through the third loop, and (A) is a front view, and (B) is a right side view.
Figure 10:
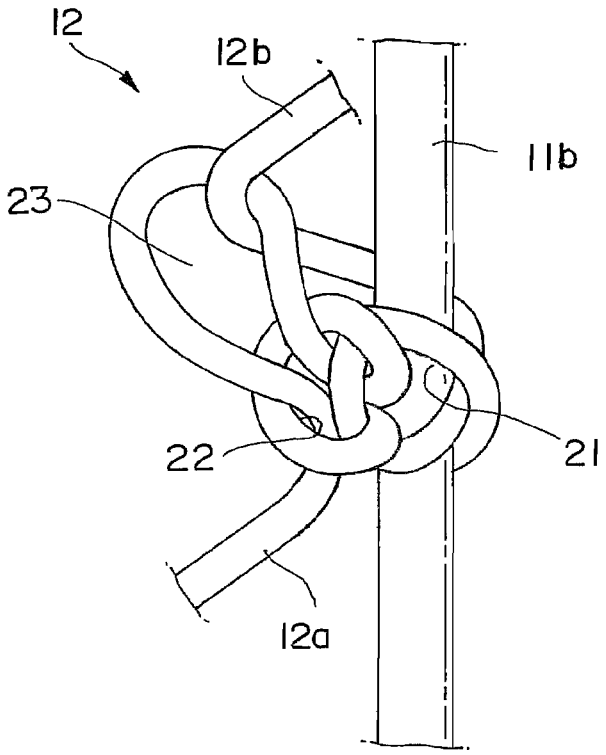
Figure 11:
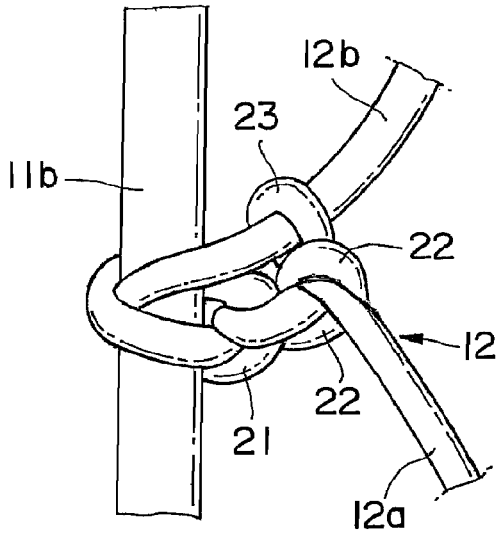
FIG. 11 Prior Art
FIG. 11 is a partially enlarged view of the state to separate the said other end portion by pulling said one end portion of hair at a final step of hair knotting, and (A) is a left side view, and (B) is a left side view during tightening.
Figure 11:
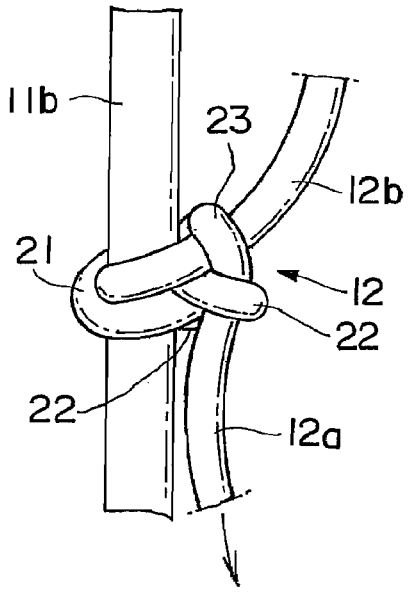
FIG. 11 Prior Art
Figure 12:
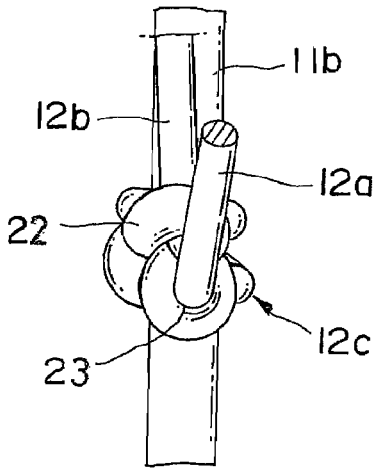
FIG. 12 Prior Art
FIG. 12 shows the extending directions of one and the other halves of hair after tightening in the completed state of hair knotting, and (A) is a front view, (B) is a right side view, and (C) is a left side view.
Figure 12:
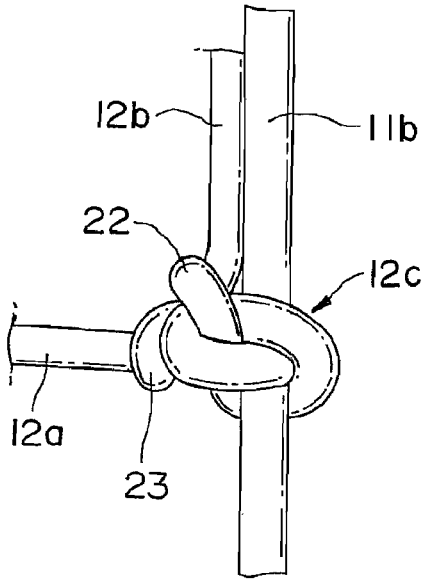
FIG. 12 Prior Art
Figure 12:
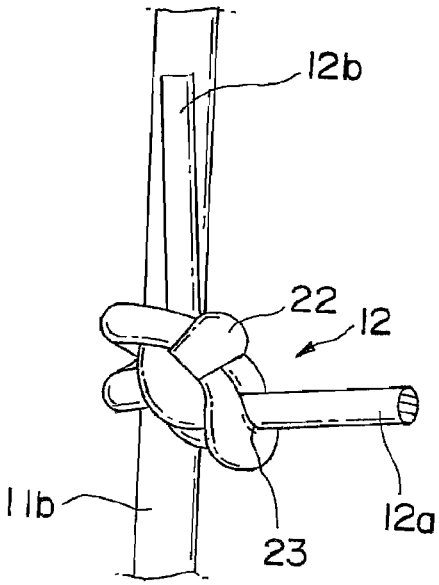
FIG. 12 Prior Art

FIGS. 3-11 illustrate each step to knot hair 12 to a rib 11*b* arranged in the back and front direction of a head, and FIG. 12 shows the state of knotted hair completed by tightening.

Figure 3:
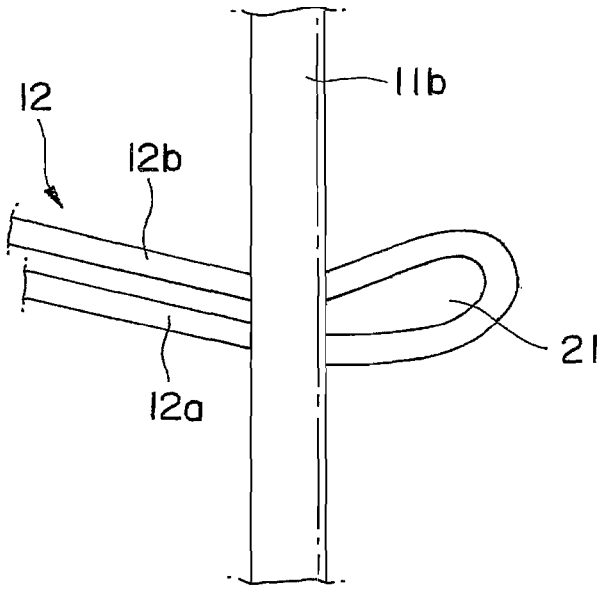
FIG. 3 is a partially enlarged diagonal view of a middle way of forming a first loop at a first step of hair knotting.

As a first step as shown in FIG. 3, a strand or a bundle of 2-4 strands of hair 12 (a strand is shown in the figure) brought to the lower side of a rib 11*b* from the left side in the figure of the rib 11*b* is hooked with a hook-shaped hair-tying needle brought to its lower side (the side contacting scalp) from the right side of the rib 11*b*.

Figure 4:
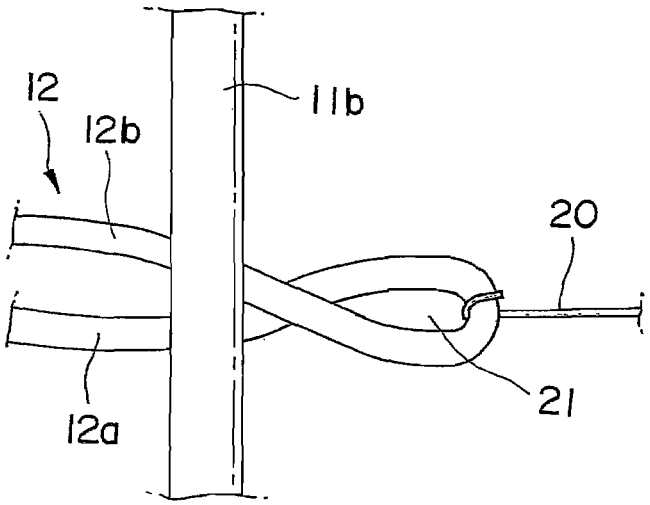
FIG. 4 is a partially enlarged diagonal view illustrating the state of the first loop twisted half a turn at a first step of hair knotting.

In this case, a loop is formed first by bending hair 12, for example, at about the middle portion, a hair-tying needle 20 is hooked to this loop, and, as shown in FIG. 4, the loop is twisted by half rotating the hair-tying needle 20 anticlockwise on the figure.

In FIG. 4, twisting is conducted so that the other end portion 12*b* of hair comes above one end portion 12*a* of hair which is made a pair by bending. Thus, a first loop 21 is formed. Said first loop 21 is taken up from the lower side of the rib 11*b*, and wound upward above the rib 11*b*.

In the actual hair planting work at said first step, the hair-tying needle 20 is hooked to the first loop 21, and thereafter is twisted by one rotation anticlockwise on the figure so that the hook of the hair-tying needle 20 turns upward (illustration omitted). In this state, the first loop 21 is wound around the rib 11*b* by moving the hair-tying needle 20 from the lower to the upper side of the rib 11*b*. In this case, if the positions are interchanged of one end portion 12*a* and the other end portion 12*b* of hair, the first loop 21 is in the twisted state by half rotation (See FIG. 4).

Figure 5:
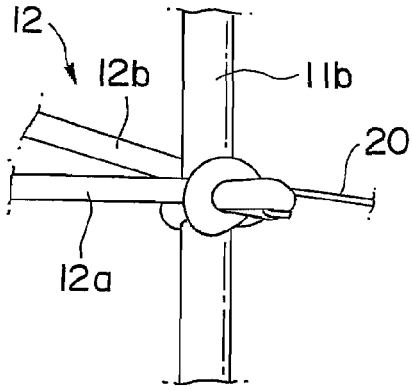
FIG. 5 is a partially enlarged view of a middle way of forming a second loop at a second step of hair knotting, and (A) is a front view, and (B) is a right side view.
Figure 5:
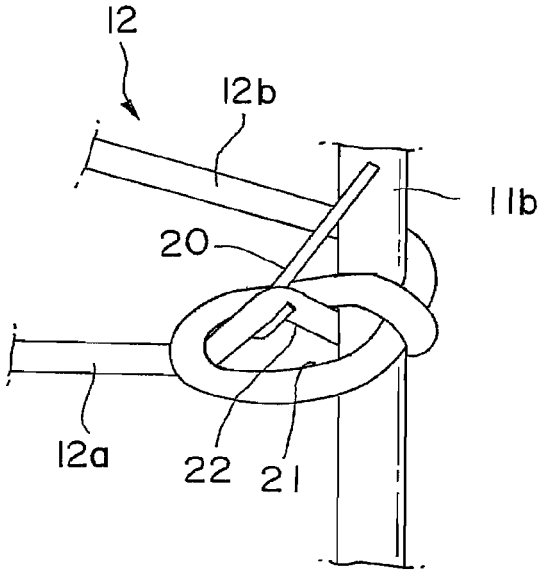

After bending the first loop 21 wound around the rib 11*b* to the other end portion (the left side in the figure), as a second step as shown in FIG. 5, the hair-tying needle 20 is inserted through the first loop 21, hooking and scooping one end portion 12*a* of hair 12, and is pulled into the first loop 21. FIG. 5 (A) is a front view of a middle way of pulling one end portion 12*a* of hair 12 into the first loop 21 using the hair-tying needle 20, and (B) is a right side view.

Figure 6:
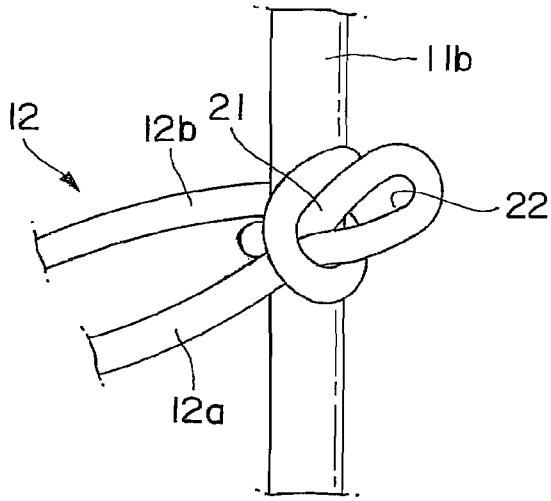
FIG. 6 is a partially enlarged front view illustrating the state of forming a second loop at a second step.

As shown in FIG. 6, a second loop 22 is formed with one end portion 12*a* of the scooped hair. In this case, the second loop 22 may be inverted by half rotating the hair-tying needle 20. Of course, the process may proceed to the next step without inversion.

Figure 7:
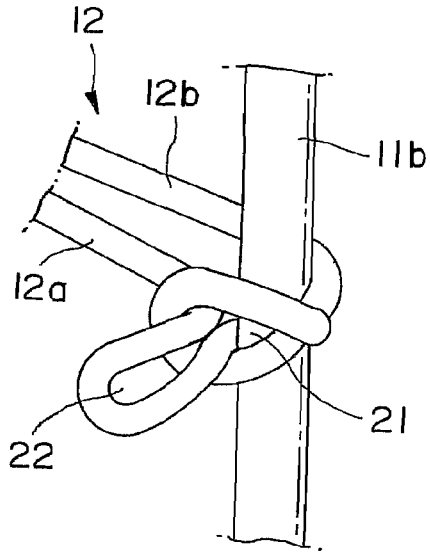
FIG. 7 is a right side view of said second loop.
Figure 8:
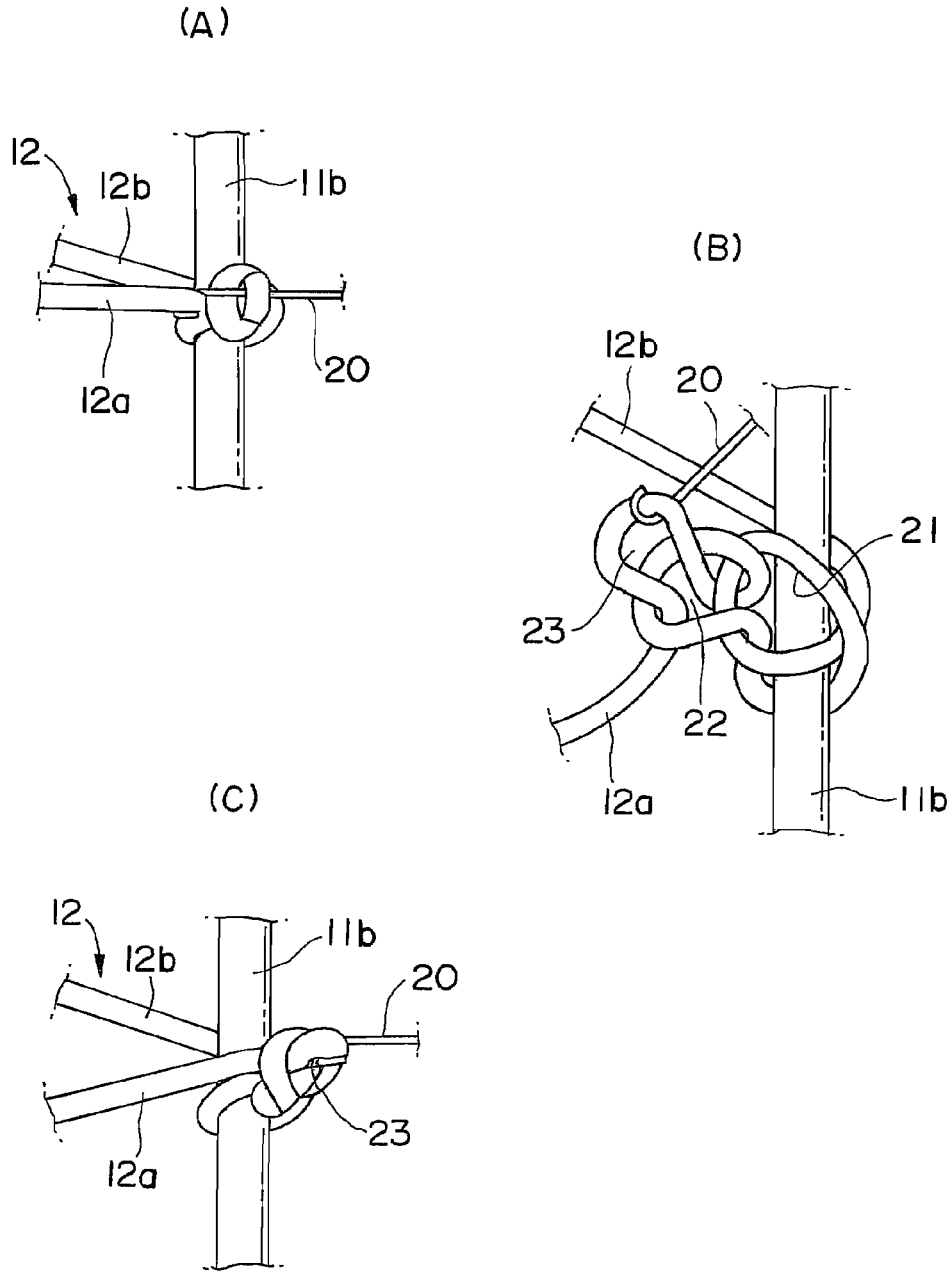
FIG. 8 is a partially enlarged view of a middle way of forming a third loop at a third step, and (A) is a front view, (B) is a right side view forming the third loop by passing one end portion of hair through the second loop, and (C) is a left side view.

As a third step as shown in FIG. 7, said second loop 22 is bent to the other end portion (the left side in the figure) using the hair-tying needle 20 which is inserted into said second loop 22 as shown in FIG. 8, one half 12*a* of said hair 12 is again hooked and scooped, and is pulled into the second loop 22. A third loop 23 is formed above the second loop 22 with one half 12*a* of the scooped hair 12. Here, FIG. 8 (A) is a front view of the state to scoop one half 12*a* of hair with the hair-tying needle 20, (B) is a right side view of the state to pull one half 12*a* of the scooped hair into the second loop 22, but illustrates the state before tightening to clearly show the knotting step. (C) is a left side view.

Figure 9:
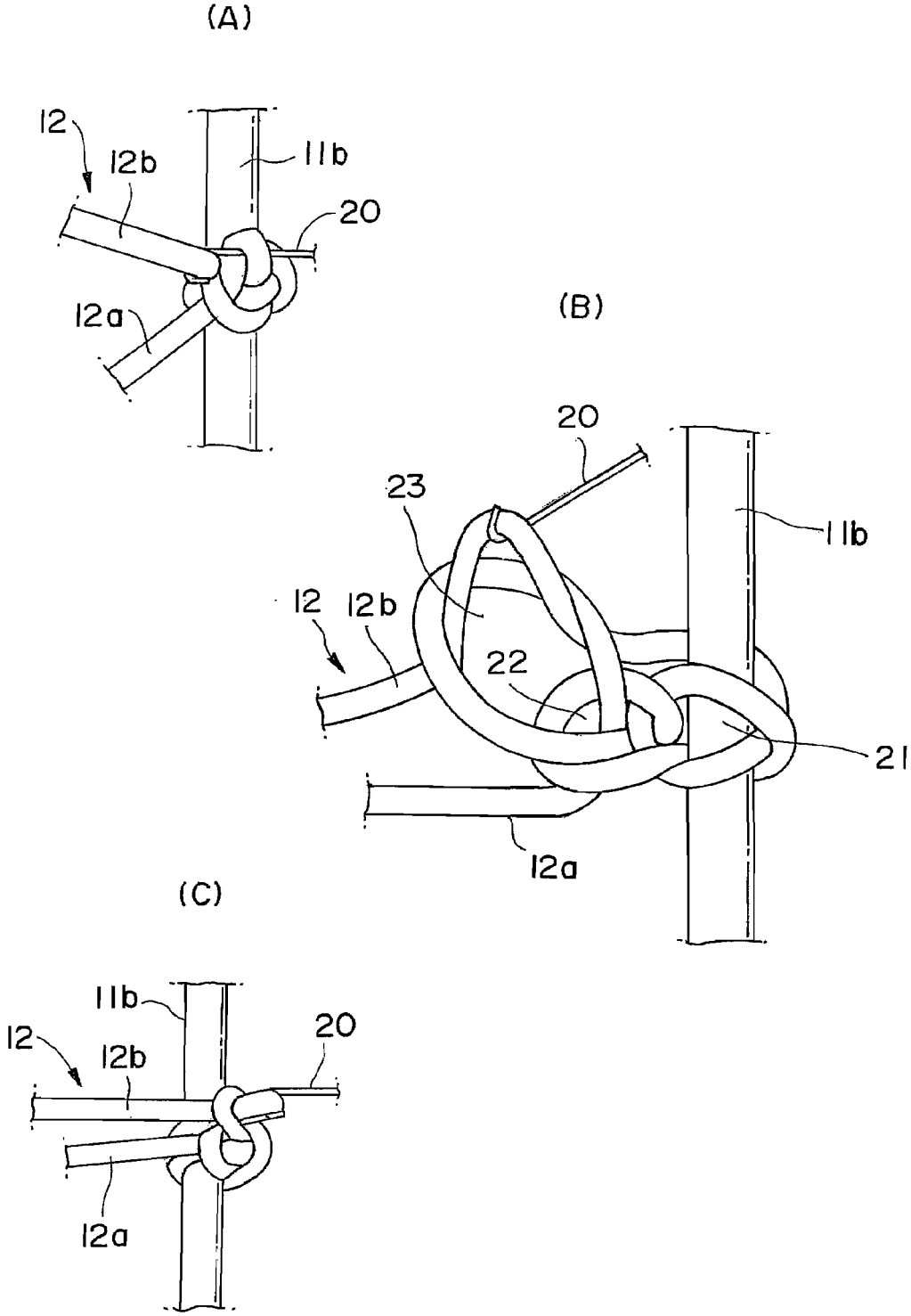
FIG. 9 is a partially enlarged view of the state to insert the other end portion of hair into the third loop at a fourth step of hair knotting, and (A) is a front view, (B) is a right side view of the state to pull the other end portion of hair into the third loop, and (C) is a front view of the state to pull the other end portion of hair into the third loop.

As a fourth step that follows as shown in the front view of FIG. 9 (A), the hair-tying needle 20 is inserted into the third loop 23, and hooks and scoops in this case the other end portion 12*b* of hair, and, as shown in FIGS. 9 (B) and (C), the hair-tying needle 20 is pulled out completely the other end portion 12*b* of the scooped hair from said third loop 23, as shown in FIG. 10. The state of the other end portion 12*b* of hair pulled out from the third loop 23 is illustrated in FIG. 10 (B). In this state, one end portion 12*a* of hair extends to the left side in the figure, and the other end portion 12*b* extends to the right side in the figure. The hair knotting step to the rib is thus completed.

The final step is a process to tightly binding the knotted hair. In this case, if both halves 12*a* and 12*b* of said hair 12 are held with fingers, for example, one end portion 12*a* is grabbed with left fingers, the other end portion 12*b* grabbed with right fingers, and then one end portion 12*a* is pulled in the direction of an arrow mark of FIG. 11, a loose knot is gradually tightened, and one end portion 12*a* and the other end portion 12*b* of hair slide in the opposite direction (lower and upper directions in the figure) along the rib 11*b*, as shown in FIG. 11, so that each of the first, second and third loops 21, 22 and 23 is tightened.

When one end portion 12*a* of hair is further tightened in the arrow mark direction of FIG. 11 (B), the third loop 23 passes through the opening of the second loop 22, as shown in FIG. 12, is brought above said second loop 22, and ultimately forms a loop at the uppermost portion in the approximately horizontal direction. Therefore, one end portion 12*a* of hair passes through the opening from the lower side of said third loop 23 to protrude upward, supported by the third loop 23, and stands upright above the rib 11*b* and extends upward.

The second loop 22 is pressed on to the rib 11*b* with said third loop 23 below the third loop 23. Therefore, the other end portion 12*b* of hair is in the state of being clipped and pressed between the second loop 22 and the rib 11*b*, and lies and extends horizontally on said rib 11*b* toward the tip of the rib 11*b* (upper direction in FIGS. 12 (A) and (B)).

Thus, at the final fifth step, when one end portion 12*a* of hair is pulled and tightened, one end portion 12*a* of hair 12 is supported mainly with the third loop 23, as shown in FIG. 12, and can extend vertically upward above the rib 11*b*. That is, since the third loop 23 is formed approximately horizontally so as to open in the upward and downward direction at the uppermost position of the knot, one end portion 12*a* of hair is tightened and supported therearound with ring-shaped hair, as the third loop 23 opening upward above the rib 11*b* is closed. Thus, one end portion 12*a* of hair is supported vertically with the third loop 23, and extends in the vertical direction to the rib 11*b*. However, the tip portion of hair 12*a* curves downward by flexibility.

On the other hand, the other end portion 12*b* of hair is clipped and pressed between the lower side of the second loop 22 pressed with the third loop 23 and the rib 11*b*, and extends in the longitudinal direction of said rib 11*b* on said rib 11*b*. Therefore, if a number of strands of hair 12 are densely knotted to the rib 11*b*, the rib 11*b* is completely covered and hidden with the other halves 12*b* of hair, so that the rib 11*b* is hardly exposed, and hair flow can be formed in the forward and backward direction of a head with the other halves 12*b* of hair along the longitudinal direction of the rib 11*b*.

By repeating the above-described method of tying, strands of hair 12 of the predetermined number are tied to each rib 11*b*, and thereby a hair-increasing device 10 can be produced.

Here, for a connecting rib 11*a* shown in FIG. 1, that is, a rib in the traversal direction, since hair flow in the forward and backward direction can be formed, if hair planting is conducted using a known knotting method, for example, split-knot planting, it is in the same direction as the above-mentioned hair flow, and hence fits well. Alternatively, if variation is properly made depending upon hair planting positions by the knotting method of the present invention and by known knotting methods, various tasteful hair flow and hairstyle can be formed.

The hair increasing device 10 in accordance with embodiments of the present invention is constituted as described above, and is used by wearing at the predetermined position of a user's head. Since said hair-increasing device 10 is such that one end portion 12*a* of each hair 12 is tied to stand upright in the approximately vertical direction from a rib 11*b*, it has rich voluminous appearance.

Since the other end portion 12*b* of hair makes hair flow extending along the longitudinal direction on the rib 11*b*, the rib 11*b* is covered with hair 12, and hence it is almost invisible from outside. Also, since hair flow is easily formed along the longitudinal direction on each rib 11*b*, a hair style rich in variation can be realized.

As for each hair 12 knotted to a hair-secured frame 11 of a hair-increasing device 10, since one end portion is knotted by twice winding, and the other end portion is knotted by once winding and pulling out thereafter, knots would not loosen, and moreover since the other end portion is wound only once, knots would not become so large, and would not cause bad feeling on skin by contact of knots on the scalp upon wearing of the hair-increasing device 10.

As has been described, according to the present invention, a hair-increasing device and a method of planting thereon are provided which offer a hair-secured frame and its rib hardly visible, knots hardly loosened, and good upright standing.

EXAMPLE

First of all, ribs 11*a* and 11*b* of a proper number were prepared by cutting twined nylon filament of 1.2 mm diameter to the predetermined size as a linear member, assembled to the predetermined shape suited to a user's head shape, and each of their cross sections was mutually connected by supersonic bonding, thereby a hair-secured frame 11 was produced.

Next, the connected hair-secured frame 11 was placed on a plaster pattern of the wig wearer's head shape prepared in advance, shaping of the hair-securing frame was conducted of the wig wearer's head shape by heating at 170° C. for 3 hours, the surface of each of ribs 11*a* and 11*b* was made coarse.

Thereafter both tip portions of each of ribs 11*a* and 11*b* were soaked in nylon solution dissolved in organic solvent, and solidified by cooling, or were coated with or soaked in a thermosetting resin solution and dried, thereby each swollen portion 11*c* was formed.

By the fastening method explained by the above-mentioned producing method (See FIGS. 3-12), hairs of the predetermined number were tied to each rib 11*b*. Finally, by bonding and fixing the tied hair to each rib with an adhesive for hair, the hair-increasing device 10 was obtained.

COMPARATIVE EXAMPLE

A hair-increasing device of Comparative Example was produced, using the same hair-secured frame 11 and rib 11*b* as Example, and by the conventional method of knotting hairs of the same number.

Outlook inspection was conducted next for Example and Comparative Example.

In case of the hair-increasing device 10 of Example, it turned out that hair flow of the tied hair 12 was formed in the longitudinal direction of the rib 11*b*, and the rib 11*b* is not exposed, and hence has good appearance compared with Comparative Example. On the other hand, in case of Comparative Example, since hair flow was formed on left and right sides of the rib 11*b*, hair dividing was caused as time elapsed in spite of brushing and combing, and the rib tended to be exposed, hence appearance turned out to be poorer than Example. As hair lied down, rich voluminous appearance was also poor.

Next, the hair-increasing device 10 of Example was worn by a tester, and outlook observation was conducted after blended with the wearer's own hair. Then, the presence of the rib 11*b* was not observed.

Also, hair flow of the wearer's own hair and that of the hair 12 knotted on the hair-increasing device 10 fitted one another well, wearing of the hair-increasing device 10 was undetectable even upon long time wearing, and appearance was excellent.

Heretofore, suitable embodiments of the present invention were explained, but the present invention is not limited only to these embodiments, but proper modification is possible within the range of the present invention. For example, the color or size of knotted hair 12 may be chosen freely, and particularly in case for decoration, hair 12 of various color may be knotted to the ribs 11*a* and 11*b*. Also as a linear member, it is not limited only to the ribs 11*a* and 11*b* shown in the above-mentioned Example, but obviously filaments constituting a wig base made of ordinary net member, and other various linear, rod-shaped, or belt-shaped materials may also be applicable. The method of hair planting of the present invention is also obviously applicable to a film-like wig base formed with artificial skin or textile sheet or film. Further, concrete numerical values and others explained in said embodiments may be properly changeable as is required. It is of course possible to add a process, after hair is attached by the present invention, of bonding and fixing to the linear member with an adhesive for hair.

Here, as an embodiment, an example was shown in which a loop 21 was formed at a first step by twisting a bent portion of hair anticlockwise, and laying the other end portion 12*b* of hair on one end portion 12*a*, followed by knotting in turn, but a loop may be formed by twisting a bent portion of hair clockwise, and laying one end portion 12*a* of hair on the other end portion 12*b*, and the process may proceed on to next step (illustration omitted). In this case, one end portion 12*a* and the other end portion 12*b* of hair are knotted in turn in the reverse order to the above-mentioned explanation, and finally, the other end portion of hair stands and extends upward from the knot with respect to a linear member, as well as one end portion lies and extends from the knot on and along the linear member. In the present invention, one end portion and the other end portion of hair are a relative concept, and it is obvious that which side is defined as one half or the other half is not an important factor of the present invention.

What is claimed is:

1. A hair-increasing device, provided with a linear member and hair tied to said linear member, comprising:

a first loop formed by twisting a bent portion of bent hair having one end portion and another end portion, a second loop formed with one end portion of the bent hair by winding said first loop around the linear member and passing said one end portion of the bent hair through said first loop, a third loop formed with said one end portion by passing said one end portion through said second loop, and a knot, which is made with said one end portion and the other end portion of the bent hair, formed by tightly knotting said first, second and third loops, wherein said one end portion of hair stands and extends upward from said knot with respect to the linear member, and said other end portion of hair, which is pulled out through said third loop, extends on and along said linear member, and wherein when said first, second and third loops are tightly bound, said third loop opens in the vertical direction at the uppermost position with respect to the linear member, said one end portion of hair protruding upward from said third loop is supported with said third loop, and stands upright with respect to said linear member, and said other end portion of hair is clipped and pressed between said second loop and said linear member beneath the pushed down second loop, and extends on and along said linear member.

2. The hair-increasing device according to claim 1, wherein said linear member is a filament constituting a net member of a wig base.

3. The hair-increasing device according to claim 1, wherein said linear member is made of rib cage-shaped ribs formed by assembling a plurality of rigid synthetic fiber filaments having elasticity.

4. The hair-increasing device according to claim 3, wherein:

a hair-secured frame is made by assembling a plurality of said ribs, and said hair-secured frame is worn on a user's head, and is mixed with the user's own hair.

5. A method of knotting hair to a linear member constituting a hair-increasing device comprising:

a first step to bring a hair-tying needle beneath the linear member, to hook and scoop the bent portion of bent hair with said hair-tying needle, and to form thereafter a first loop by twisting;

a second step to wind said first loop around the linear member, to scoop one end portion of hair by inserting the hair-tying needle through said first loop, and to form a second loop with said one end portion of hair scooped through said first loop;

a third step to scoop again said one end portion of hair by inserting the hair-tying needle through said second loop, and to form a third loop with said one end portion of hair scooped through said second loop;

a fourth step next to scoop said other end portion of hair by inserting the hair-tying needle through said third loop, and to pull out completely said scooped other end portion of hair from the third loop; and a final fifth step to have one end portion of hair stand upright with respect to the linear member by tightening said first, second and third loops, and to have said other end portion extend on and along said linear member.

6. A method of producing a hair-increasing device provided with a linear member and hair tied to said linear member, comprising:

a first step to bring a hair-tying needle beneath the linear member, to hook and scoop the bent portion of bent hair with said hair-tying needle, and to form thereafter a first loop by twisting;

a second step to wind said first loop around the linear member, to scoop one end portion of hair by inserting the hair-tying needle through said first loop, and to form a second loop with said one end portion of hair scooped through said first loop;

a third step to scoop again said one end portion of hair by inserting the hair-tying needle through said second loop, and to form a third loop with said one end portion of hair scooped through said second loop;

a fourth step next to scoop said other end portion of hair by inserting the hair-tying needle through said third loop, and to pull out completely said scooped other end portion of hair from the third loop; and a final fifth step to have said one end portion of hair stand upright with respect to the linear member by tightening said first, second and third loops, and to have the other end portion extend on and along said linear members, and tying hair to said linear member covering the same with said other end portion of hair by repeating in turn said first to fifth steps.

7. The method of producing a hair-increasing device according to claim 6, wherein said first loop is formed by twisting half a turn of the bent portion of bent hair, and crossing said other end portion on said one end portion of hair.

8. The method of producing a hair-increasing device according to claim 6, wherein at said second step, said scooped one end portion of hair is passed into the first loop to form a second loop, and said second loop is twisted half a turn.

9. The method of producing a hair-increasing device according to claim 6, wherein at said third step, said one end portion of hair is passed into the second loop to form a third loop, and said second loop is twisted half a turn.

10. The method of producing a hair-increasing device according to claim 6, wherein at said fifth step, by pulling said one end portion of hair to tighten said first, second and third loops, the third loop passes through, and protrudes from the second loop, and opens in the vertical direction at the uppermost position with respect to the linear member, and said one end portion of hair passes through the third loop from the lower end portion of said third loop and protrudes upward, thereby stands upright supported with said third loop with respect to said linear member, and further as said third loop presses said second loop downward, the other end portion of hair is clipped and pressed between said second loop and said linear member, and extends on and along said linear member.

11. The method of producing a hair-increasing device according to claim 5 or 6, wherein said linear member is a filament constituting a net member of a wig base.

12. The method of producing a hair-increasing device according to claim 5 or 6, wherein said linear member is made of ribs formed by assembling a plurality of rigid synthetic fiber filaments having elasticity.

13. The method of producing a hair-increasing device according to claim 12, wherein a plurality of said ribs are assembled to form a frame of the predetermined shape, and thereafter said hair is knotted to each rib constituting said frame.

* * * * *